US006038981A

United States Patent [19]

Daberkow et al.

[11] Patent Number: 6,038,981

[45] Date of Patent: Mar. 21, 2000

[54] TWO-WHEELED BOGIE FOR TRACK-GUIDED VEHICLES

[75] Inventors: Andreas Daberkow, Frankfurt, Germany; Ralf Krause, Bethel Park, Pa.; Norbert Ott, Hanau; Rolf Krouzilek, Berlin, both of Germany

[73] Assignees: Daimler-Benz Aktiengesellschaft, Stuttgart; ABB Daimler-Benz Aktiengesellschaft, Henningsdorf, both of Germany

[21] Appl. No.: 09/051,495

[22] PCT Filed: Oct. 10, 1996

[86] PCT No.: PCT/EP96/04411

§ 371 Date: Apr. 13, 1998

§ 102(e) Date: Apr. 13, 1998

[87] PCT Pub. No.: WO97/14597

PCT Pub. Date: Apr. 24, 1997

[30] Foreign Application Priority Data

Oct. 14, 1995 [DE] Germany ..... 195 38 379

[51] Int. Cl.[7] ..... B61F 5/00

[52] U.S. Cl. ..... 105/168

[58] Field of Search ..... 105/3, 165, 167, 105/168, 169, 199.3, 199.5

[56] References Cited

U.S. PATENT DOCUMENTS

| | | | |
|---|---|---|---|
| 39,332 | 7/1863 | Arnoux | 105/165 |
| 402,950 | 5/1889 | Maloy | 105/169 |
| 431,072 | 7/1890 | Odell | 105/165 |
| 1,416,775 | 5/1922 | Bauer | 105/165 |

FOREIGN PATENT DOCUMENTS

| | | |
|---|---|---|
| 0 282 738 | 9/1988 | European Pat. Off. . |
| 0 295 462 | 12/1988 | European Pat. Off. . |
| 2 240 852 | 3/1975 | France . |
| 590867 | 12/1933 | Germany . |
| 34 09 103 | 9/1985 | Germany . |
| 37 44 983 | 12/1988 | Germany . |
| 479714 | 2/1938 | United Kingdom . |

OTHER PUBLICATIONS

H.R. Kaser et al., "'Cobra'—die Schindler–/SIG–Niederflurtechnologie," Nahverkehrs–Praxis, No. 11/1992, pp. 402–404, 406 and 408.

Von Leopold Lenk et al., "Neue Fahrwerke zur Niveauabsenkung des Fahrgastfuβbodens bei schienengeführten Stadtverkehrsmitteln," ZET+DET Glas. Ann. 116, No. 8/9, 1992, pp. 333–343.

*Primary Examiner*—Mark T. Le
*Attorney, Agent, or Firm*—Venable; Norman N. Kunitz; Michael Leary

[57] ABSTRACT

A two-wheeled running gear for a track-guided vehicle comprising a running gear frame; a wheel carrier; first and second wheels coupled to opposite sides of the wheel carrier; first and second vertical pivot pins, the first vertical pivot pin coupled to the first side of the wheel carrier and movably connected to the first side of the running gear frame, the second vertical pivot pin coupled to the second side of the wheel carrier and movably connected to the second side of the running gear frame, the first and second wheels located between the first and second vertical pins; and means for controlling a movement of the first pivot pin relative to the running gear frame such that, during a curved track drive, the first pivot pin can be held substantially in place relative to the running gear frame while the second pivot pin can move relative to the running gear frame so that the line connecting the centers of the wheels is maintained substantially parallel to the radius of curvature of the track.

17 Claims, 5 Drawing Sheets

TWO-WHEELED BOGIE FOR TRACK-GUIDED VEHICLES

FIELD OF THE INVENTION

The invention relates to a two-wheeled running gear for track-guided vehicles, having a traction-assisted means for steering and having a wheel carrier.

BACKGROUND OF THE INVENTION

Since track-bound, and in particular rail-guided, vehicles for high-speed, regional and local transport have been equipped virtually exclusively with bogie-type running gears, so-called individual-wheel running gears have also recently become established. Whereas bogies have two or more sets of wheels or four or more so-called individual wheels, and are thus very heavy, individual-wheel running gears have two individual wheels, and individual-wheel-set running gears have one set of wheels.

In the case of track curves, bogies are steered by the leading set of wheels or the leading individual wheels. The small axle spacing or wheel spacing means that the wheels travel through curves with only a small amount of noise and low wear, and two or more bogies beneath the carriage body provide for stable guidance along a rectilinear track at relatively high speeds. Additional steering of the sets of wheels or individual wheels in the bogie is achieved by the diagonal connection between two sets of wheels or by utilizing the angular movements of leading and trailing carriage bodies.

Two-wheeled individual-wheel running gears have become widespread, in particular, in local and regional transport. Individual wheels make it easier in design terms to provide for simple entrance into carriages by virtue of the carriage floor being lowered to a level of approximately 300 mm, which is the case in so-called low-floor vehicles. If the so-called rolling condition, which is characterized by virtually identical rolling and circumferential speeds for the wheels which are respectively on the inside and outside of the curve, and the so-called adjustment condition, which describes the adjustment of the wheel planes tangentially, or of the wheel axles radially, with respect to the rails, are maintained, there is a virtually physically ideal reduction in wear and noise, and thus a high degree of comfort. Various methods are used in order to realize this ideal track guidance.

"Nahverkehrs-Praxis", no. 11/1992, p. 402 ff., discloses a three-part articulated vehicle with, in each case, two individual-wheel running gears per carriage body. Two individual wheels are arranged in one wheel carrier and, for each carriage, two wheel carriers are mounted in the running gear frame of the carriage body so as to be pivotable about the vertical pin in each case. The vertical king pin for the pivot pin is located in the center between the wheels of the wheel carrier, in the plane of symmetry of the vehicle. The curve-dependent pivoting or steering of the wheel carriers is effected by an additional steering linkage with respect to the pin-free articulation. In this case, the steering linkage is moved in dependence on the articulation angle between the carriage bodies, and the articulation angle is adjusted in a curve-dependent manner, with the result that the wheel carriers can be adjusted approximately radially with respect to the curve. Similar positively controlled steering of individual-wheel running gears, with, in each case, two individual wheels per running gear and a portal-like articulated structure, was developed in Austria (cf. ZEV+DET Glas. Annalen 116 (1992) no. 8/9, p. 333 ff.).

An individual-wheel running gear with self-regulating individual wheels is described in DE 34 09 103 A1 and DE 37 44 983 C2. Each of the individual wheels can be steered about a dedicated vertical pivot pin. The individual-wheel carriers, which are located opposite one another on the inside and outside of the curve, are connected by a track rod. By way of the vertical pivot pins, which are located outside the stand-up points of the wheels, the forces produced during wheel/rail contact are utilized in order to guide the wheel planes back tangentially with respect to the rail, with the result that the wear between wheel and rail is reduced considerably.

EP 02 95 462 B1 discloses an individual-wheel running gear structure which is equipped with actuating devices. Two individual wheels are arranged in a wheel carrier, and two wheel carriers are mounted in a running gear frame so as to be pivotable about the vertical in each case. The king pin, which actually forms the vertical pivot pin, is located in the centre between the wheels of a wheel carrier, in the plane of symmetry of the running gear frame. The curve-dependent pivoting of the wheel carriers is effected by one actuating device for each wheel carrier. The actuating is supported on the running gear frame and, in dependence on an adjacent carriage body connected to the carriage body in an articulated manner, pivots each wheel carrier about the fixed pivot in the wheel-carrier center.

With curve control for individual wheels which is configured in dependence on the carriage-body articulation angle, the error in the adjustment which is correct for the curve increases as the articulation angle increases. Furthermore, it is not possible to achieve precise tangential positioning of the individual-wheel planes in the transition curve. The numerous articulations and connections of the steering linkage require a not inconsiderable amount of outlay for maintenance and adjustment.

In the case of individual-wheel running gears with self-regulating, individually driven individual wheels, the influence of traction forces on the steering behavior may result in undesired travelling movement. In terms of production and heat, differential drive torques between the traction motors cannot be avoided, and these torques result in differential traction forces which may lead to undesired steering. These differential traction forces may also result from tolerance-dependent or transverse-displacement-dependent changes in the radius of the rolling circle of the driven individual wheels. Furthermore, with very small track-curve radii and a large axle spacing, there is a reduction in the gauge of these individual wheels steered in such a manner.

If the wheel carriers, which can be rotated about a vertical pin, are made to pivot by hydraulic actuating members, then a need for a not inconsiderable amount of space and high energy outlay should be expected since the wheel/rail contact forces which counteract the steering movement have to be overcome by the actuating members. When the vehicle is travelling through a curve, failure of a hydraulic actuating member constitutes a risk to travelling safety. If the influence of the traction forces on the track guidance cannot be eliminated, then the hydraulic actuating members additionally have to compensate traction-force differences.

SUMMARY OF THE INVENTION

The object of the invention is thus to provide a two-wheel running gear which has an individual-wheel drive for track-guided vehicles with controlled steering and, with minimal wear, high safety and low design outlay, can both travel through narrow track curves and can also achieve relatively high speeds along a rectilinear track.

This object is achieved according to the invention by the features according to a two-wheeled running gear for track-guided vehicles, having a traction-assisted means for steering and having a wheel carrier. The two wheels (4 and 4') on the common wheel carrier (3) are aligned parallel to one another on an (imaginary) connecting line between the individual-wheel axles, the connecting line being perpendicular with respect to the wheel circumference, and are arranged at a uniform spacing from one another. The wheel carrier (3) has two alternatively usable, vertical pivot pins (2 and 2') which are located outside the stand-up points of the wheels. A pivot pin (2, 2') is arranged on each side of the wheel carrier (3), and can be adjusted and arrested in the horizontal in dependence on the radius of the track curve. The wheel carrier (3) can be steered about a non-adjusted, arrested pivot pin (2 or 2'), which is located in a central position and is on the inside or outside of the curve. The invention thus avoids the disadvantages mentioned above.

In contrast to the running gears which have been described from the prior art, the running gear which is designed according to the invention does not have a central vertical pivot pin per wheel carrier with two individual wheels, but rather has two vertical pivot pins which are located outside the stand-up points of the wheels in each case. In particular, while the position of the pivot pin which is on the outside of the curve at any one time is arrested, the wheel carrier is pivoted alternately about precisely this pin. The wheel carrier, with specific application of differential traction forces, is adjusted tangentially with respect to the rail and is retained at the desired steering angle by a separate arresting device. The desired steering angle is determined, for example, by a track-position measurement, and the differential traction forces are predetermined by an adjustment or regulating algorithm.

The pivot pins are actually formed by king pins. On the respective sides, the wheel carrier is steered, in dependence on the track-curve radius, and with simultaneous arresting of the horizontal displacement means of the outer pivot pin, about the pivot pin. The pivot movement may also be effected actively, for example by a pneumatic or hydraulic pivoting device or by the specific application of differential traction forces, and, at the same time, be assisted by the wheel/rail contact forces. In the case of a track which has only shallow curvature or is rectilinear, the two pivot pins are arrested, as a result of which good stability is achieved at relatively high speeds and the influence of tolerance-related traction-force differences is small or comparable with non-steerable running gears. The steering and arresting operations are assisted by a convenient arrangement of the spring/damper combination, with the result that there is no danger of safety being put at risk in the event of the traction motors failing.

The advantages which can be achieved by way of the invention consist, in particular, in that the steering operation does not require any actuating devices which consume additional energy; rather, the differential traction forces of the individual-wheel-driven individual-wheel running gear control the steering operation with low energy, as a natural actuating device, and are assisted by the wheel/rail contact forces in the process.

BRIEF DESCRIPTION OF THE DRAWINGS

Exemplary embodiments of the invention are described hereinbelow and illustrated in the drawing, in which.

DETAILED DESCRIPTION OF THE INVENTION

Figure 1:
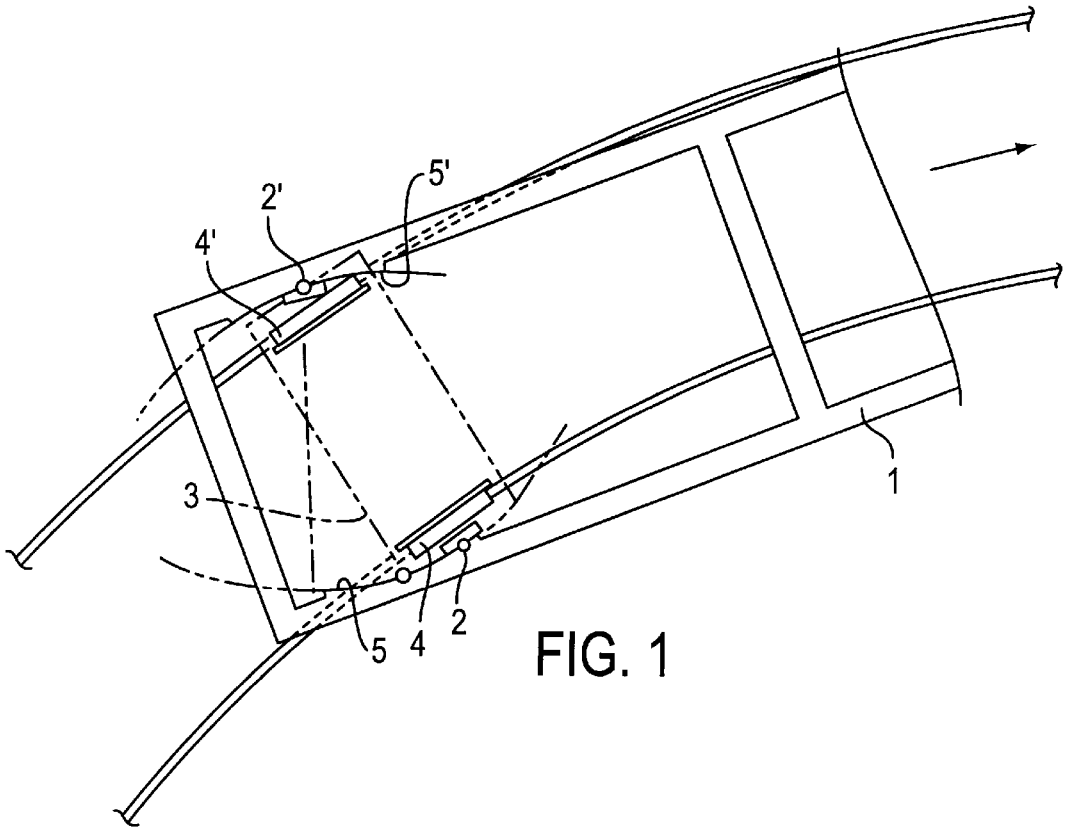
FIG. 1 shows a plan view of the principle of the running gear.

FIG. 1 shows the plan view of the principle of the running gear. The direction of movement of the running gear frame 1, which is illustrated without its leading part, is indicated by an arrow. The pivot pins (king pins) 2 and 2' of the wheel carrier 3, which can be pivoted about the vertical, show that, in the vehicle position illustrated, rotation takes place about the king pin on the outside of the curve. The actual steering rolling radius is given by the spacing of the two pivot pins. Ideally, the individual wheels 4 and 4' are located in the track, i.e. the wheel axle is radial with respect to the present radius of curvature and the wheel planes are located tangentially thereto. The reciprocal guidance of the wheel carrier 3 about the king pins 2 is effected by a bearing segment ring, of which the running-gear-frame-mounted parts 5 and 5' are illustrated in FIG. 1.

Figure 2:
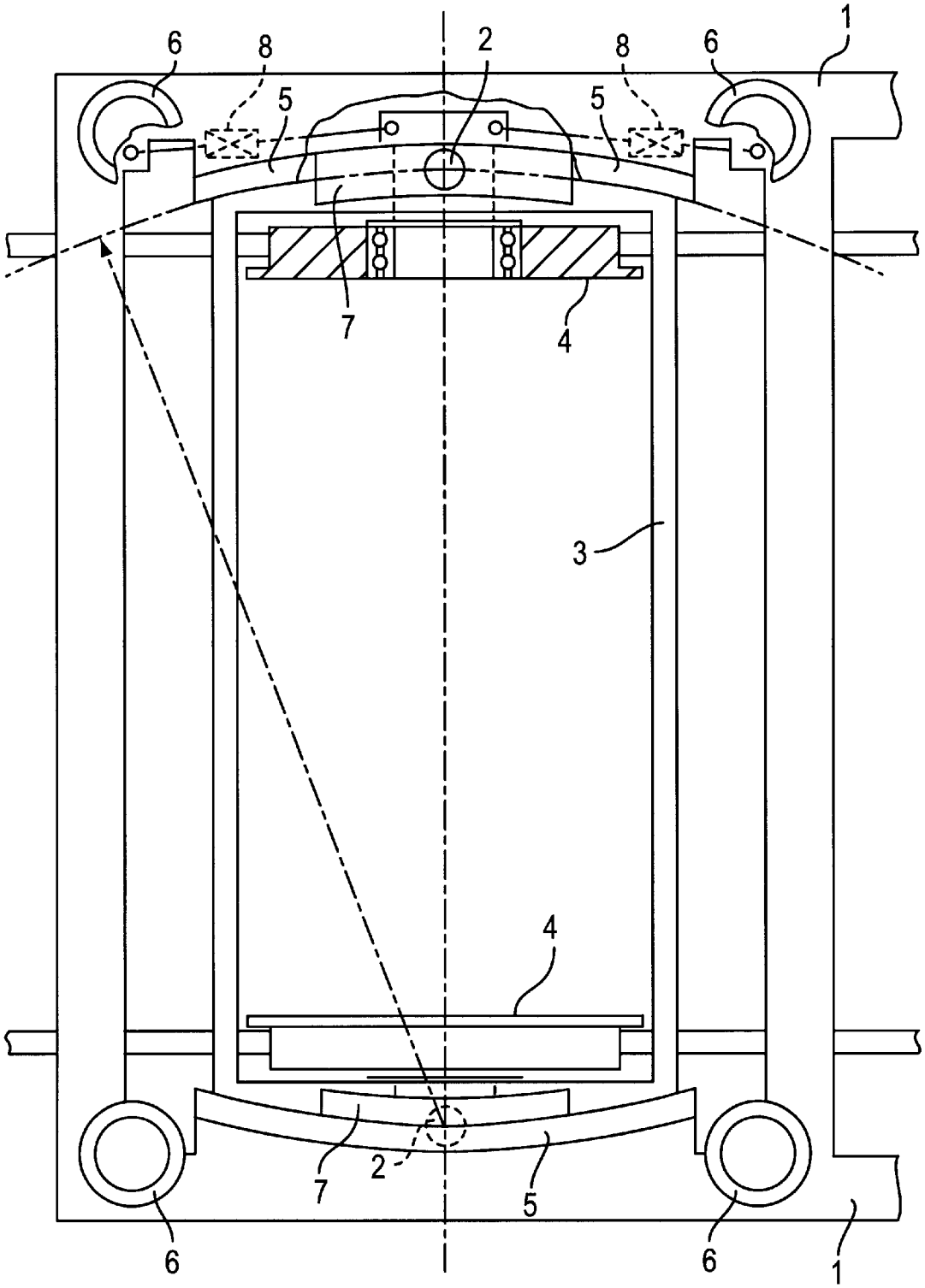
FIG. 2 shows a plan view of the wheel carrier in its mounting.

FIG. 2 shows a plan view of further details of the running gear principle. The springs 6 assume the task of suspending the running gear frame with respect to the vehicle body. On the respective sides, the wheel-carrier-mounted bearing segment rings 7 guide the pivot points 2 with respect to the vehicle frame. One exemplary embodiment of the arresting device on the respective sides is equipped as a spring/damper combination 8 with adjustable characteristic curves.

Figure 3B:
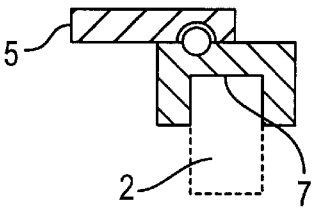
FIG. 3B shows a detailed view of FIG. 3A.
Figure 3A:
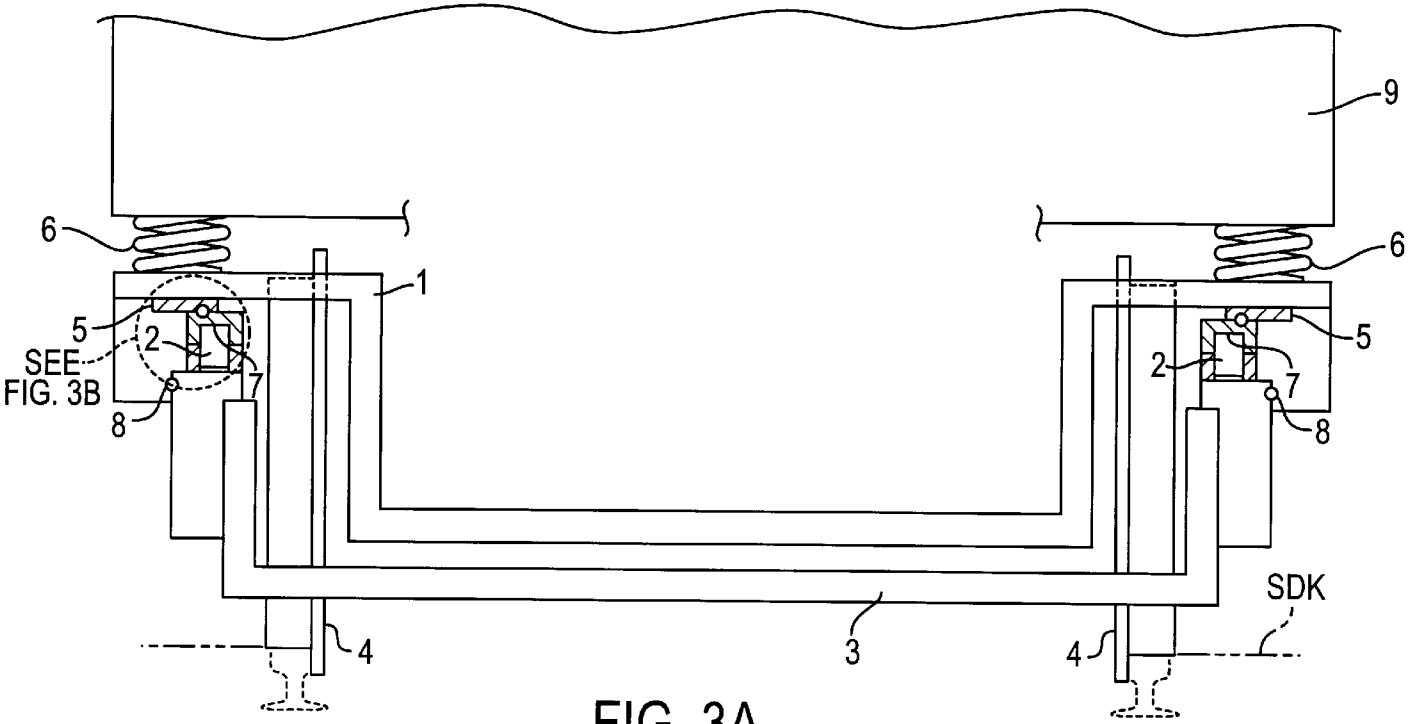
FIG. 3A shows a front view of the wheel carrier.

FIG. 3A illustrates the front view of the running gear principle. In this case, the running gear frame is configured as a so-called trough frame in order to permit a structure with a low-level carriage floor. The suspension of the vehicle body 9 is likewise illustrated in the front view. The running-gear-frame-mounted bearing segment rings 5 are illustrated in section, as are the wheel-carrier-mounted bearing segment ring 7 and the corresponding guide of the king pin 2. The arresting device 8 on the respective sides is indicated by the articulation point. A detailed view is illustrated in FIG. 3B.

Figure 7:
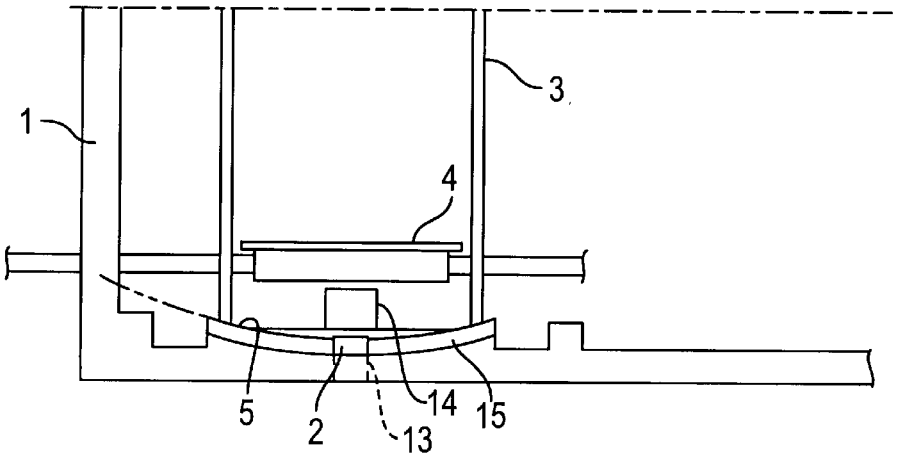
FIG. 7 shows a gear-wheel actuating device.
Figure 4:
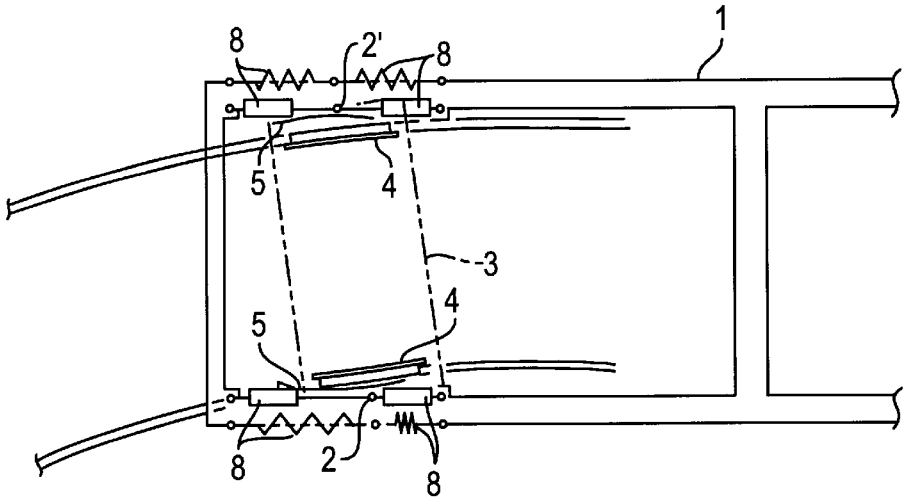
FIG. 4 shows the arrangement of the spring/damper combination.
Figure 8:
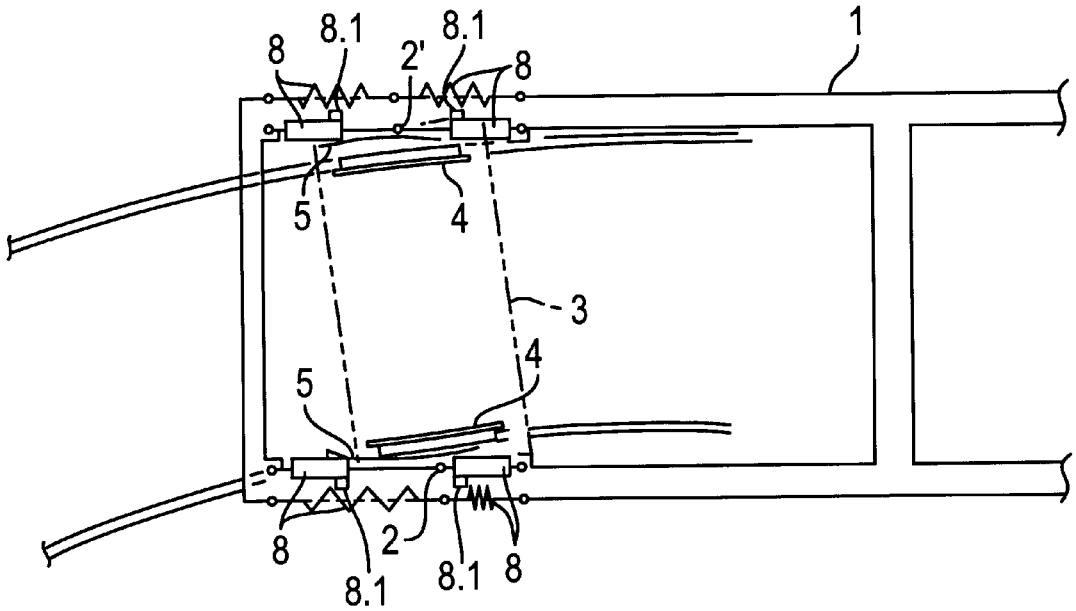
FIG. 8 shows the arrangement of a spring/damper combination provided with changeable throttle cross-sections.

FIGS. 4, 5, 6, 7 and 8 illustrate the various arresting and actuating devices in plan view. FIG. 4 shows the spring/damper combination 8, in a redundant arrangement of four, which influences the steering of wheel carrier. FIG. 8 shows a single spring/damper combination with adjustable throttle cross section 8.1 for selectively arresting pivot pins 2, 2'.

Figure 5:
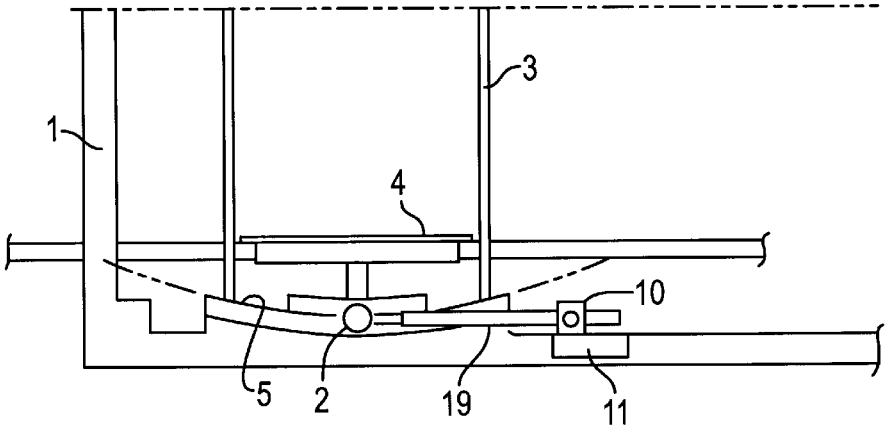
FIG. 5 shows a detail of the wheel carrier with spindle drive.

FIG. 5 illustrates the running gear in half-section with an exemplary embodiment of the nut/spindle structure. This spindle 19 is articulated on the king pin 2, and its nut 10 is articulated on the running gear frame 1 and driven by an electric motor 11.

Figure 6:
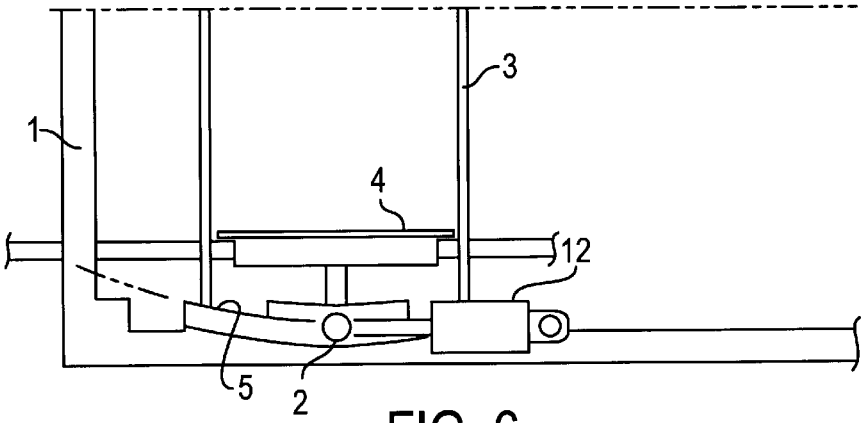
FIG. 6 shows a hydraulic actuating device.

An exemplary embodiment of the pneumatic or hydraulic actuating device 12 is represented in FIG. 6. The actuating device is articulated on the king pin 2 and on the running gear frame 1.

FIG. 7 illustrates an exemplary embodiment of the gear-wheel/toothed-ring actuating device. The toothed ring 15 is fastened on the running gear frame 1, and the motor 14 is fastened on the wheel carrier 3. Actuation of the wheel carrier is initiated in the running gear frame via the gear wheel 13. A spring/damper combination can additionally assist the actuating operation.

What is claimed is:

1. A two-wheeled running gear for a track-guided vehicle comprising:

a running gear frame having a first side and a second side opposite the first side;

a wheel carrier having a first side and a second side opposite the first side;

first and second wheels, the first wheel coupled to the first side of the wheel carrier, the second wheel coupled to the second side of the wheel carrier, each wheel having a center and a circumference, the first and second wheels being aligned substantially parallel to one another on a line connecting the centers of the wheels and the circumferences of the wheels being substantially perpendicular to the line connecting the centers of the wheels, the first and second wheels being maintained at a substantially uniform distance from one another;

first and second vertical pivot pins, the first vertical pivot pin coupled to the first side of the wheel carrier and movably connected to the first side of the running gear frame, the second vertical pivot pin coupled to the second side of the wheel carrier and movably connected to the second side of the running gear frame, the first and second wheels located between the first and second vertical pins; and means for controlling a movement of the first pivot pin relative to the running gear frame such that, during a curved track drive, the first pivot pin is held substantially in place relative to the running gear frame while the second pivot pin moves relative to the running gear frame so that the line connecting the centers of the wheels is maintained substantially parallel to the radius of curvature of the track.

2. A running gear according to claim 1, further comprising:

a first circle-arc-shaped running gear section coupled to the first side of the wheel carrier and to the first vertical pivot pin, the first vertical pivot pin being movable along the first circle-arc-shaped running gear section; and a second circle-arc-shaped running gear section coupled to the second side of the wheel carrier and to the second vertical pivot pin, the second vertical pivot pin being movable along the second circle-arc-shaped running gear section.

3. A running gear according to claim 1, wherein the vertical pivot pins are formed by king pins.

4. A running gear according to claim 2, wherein the means for controlling movement of the pivot pins further comprises at least one of a first thrust-action spring element and a first guidance link coupled to the first side of the wheel carrier and for steering the wheel carrier about a first virtual vertical pivot pin.

5. A running gear according to claim 2, wherein the means for controlling movement of the pivot pins holds one of the vertical pivot pins at any desired position along its respective circle-arc-shaped running gear section, while the other vertical pin is maintained at a zero position along its respective circle-arc-shaped running gear section.

6. A running gear according to claim 1, wherein the wheel carrier is steered such that the wheels are at least one of steered and guided radially with respect to curved track.

7. A running gear according to claim 2, wherein the means for controlling movement of the pivot pins further comprises a first changeable throttle cross-section of a first spring/damper combination coupled to the first side of the wheel carrier and for arresting the first pivot vertical pin along the first circle-arc-shaped running gear section by closing the first changeable throttle cross-section.

8. A running gear according to claim 2, wherein the means for controlling movement of the pivot pins further comprises one of a first electromagnetic and mechanical retaining device coupled to the first side of the wheel carrier and for arresting the first pivot vertical pin along the first circle-arc-shaped running gear section.

9. A running gear according to claim 2, wherein the means for controlling movement of the pivot pins further comprises a first nut/spindle structure driven by a first electric motor, coupled to the first side of the wheel carrier, and for arresting the first pivot vertical pin along the first circle-arc-shaped running gear section.

10. A running gear according to claim 2, wherein differential traction forces of the first wheel displace the first vertical pivot pin along the first circle-arc-shaped running gear section.

11. A running gear according to claim 2, wherein the means for controlling movement of the pivot pins further comprises:

a first pneumatic and/or hydraulic actuating device for displacing the first vertical pivot pin along the first circle-arc-shaped running gear section.

12. A running gear according to claim 2, wherein the means for controlling movement of the pivot pins further comprises a first nut/spindle structure driven by a first electric motor for displacing the first vertical pivot pin along the first circle-arc-shaped running gear section.

13. A running gear according to claim 2, wherein the means for controlling movement of the pivot pins further comprises a first toothed ring coupled to the first circle-arc-shaped running gear section and driven by at least one of a first electrically driven gear wheel and a first motor driven gear wheel, and for displacing the first vertical pivot pin along the first circle-arc-shaped running gear section.

14. A running gear according to claim 1, wherein the wheel carrier is steered about the vertical pivot pin located exterior to a curvature of track.

15. A running gear according to claim 1, wherein the wheel carrier is steered about the vertical pivot pin located interior to a curvature of track.

16. A running gear according to claim 1, wherein the means for controlling further comprises a first arresting device connected to the first pivot pin and a second arresting device connected to the second pin so that, on a straight track drive both pivot pins are locked in place, and on a curved track drive one pivot pin is locked in place while the other pivot pin pivots in its guide in accordance with the curvature of the track.

17. A two-wheeled running gear for a track-guided vehicle comprising:

a running gear frame having a first side and a second side opposite the first side;

a wheel carrier having a first side and a second side opposite the first side;

first and second wheels, the first wheel coupled to the first side of the wheel carrier, the second wheel coupled to the second side of the wheel carrier, each wheel having a center and a circumference, the first and second wheels being aligned substantially parallel to one another on a line connecting the centers of the wheels and the circumferences of the wheels substantially perpendicular to the line connecting the centers of the wheels, the first and second wheels being maintained at a substantially uniform distance from one another;

first and second vertical pivot pins, the first vertical pivot pin coupled to the first side of the wheel carrier, the second vertical pivot pin coupled to the second side of the wheel carrier, the first and second wheels located between the first and second vertical pins; and means for selectively arresting individually and independently the first and second vertical pivot pins, said means for arresting coupled to the wheel carrier.

* * * * *